US011486106B2

(12) United States Patent
Chaput et al.

(10) Patent No.: US 11,486,106 B2
(45) Date of Patent: Nov. 1, 2022

(54) BRUSH RETROFIT FOR A SNOW REMOVAL VEHICLE

(71) Applicants: Robert Chaput, Kemble, CA (US); Brennen Chaput, Sudbury (CA); Patrick Ratthe, Dryden (CA)

(72) Inventors: Robert Chaput, Kemble, CA (US); Brennen Chaput, Sudbury (CA); Patrick Ratthe, Dryden (CA)

( * ) Notice: Subject to any disclaimer, the term of this patent is extended or adjusted under 35 U.S.C. 154(b) by 191 days.

(21) Appl. No.: 16/814,309

(22) Filed: Mar. 10, 2020

(65) Prior Publication Data

US 2020/0318303 A1 Oct. 8, 2020

Related U.S. Application Data

(60) Provisional application No. 62/828,536, filed on Apr. 3, 2019.

(51) Int. Cl.
*E01H 5/06* (2006.01)
*E01H 5/09* (2006.01)
*A46B 13/00* (2006.01)

(52) U.S. Cl.
CPC ..... *E01H 5/092* (2013.01); *A46B 13/005* (2013.01); *E01H 5/06* (2013.01); *E01H 5/061* (2013.01);
(Continued)

(58) Field of Classification Search
CPC ... A46B 7/04; A46B 7/044; A46B 2200/3066; E01H 5/00; E01H 5/06
(Continued)

(56) References Cited

U.S. PATENT DOCUMENTS 222,036 A 11/1879 Graff
634,963 A 10/1899 Smith
(Continued)

FOREIGN PATENT DOCUMENTS

CH 695619 A5 7/2006
DE 3703470 C1 10/1988
(Continued)

OTHER PUBLICATIONS

Multihog Ltd., "Combi Snow Plough and Sweeper", Product Description, Dundalk, Ireland, 2015, Available at http://www.swedmog.se/wp-content/uploads/2015/05/9012-Combi-Spec.pdf (2 pages).
(Continued)

*Primary Examiner* — Gary S Hartmann
(74) *Attorney, Agent, or Firm* — Bereskin & Parr LLP/S.E.N.C.R.L., s.r.l.; Isis E. Caulder; Nicholas Aitken

(57) ABSTRACT

A brush retrofit for mounting behind a snow plow blade of a snow removal vehicle is disclosed. The brush retrofit includes a base frame, a stationary brush assembly, a retrofit mount, a brush elevation actuator, and a retrofit mount. The stationary brush assembly is movably mounted to the base frame. The retrofit mount is configured to secure the base frame to a support structure of the snow removal vehicle behind the snow plow blade. The brush elevation actuator when activated, moves the stationary brush assembly relative to the base frame between a raised storage position and a lowered in-use position. The retrofit mount is configured to secure the base frame to a support structure of the snow removal vehicle behind the snow plow blade.

11 Claims, 14 Drawing Sheets

(52) U.S. Cl.
CPC ..... *E01H 5/098* (2013.01); *A46B 2200/3066* (2013.01)

(58) Field of Classification Search
USPC ..... 37/232, 241
See application file for complete search history.

(56) References Cited

U.S. PATENT DOCUMENTS

| | | | | | |
|---|---|---|---|---|---|
| 2,867,827 | A | | 1/1959 | Gantz | |
| 3,230,645 | A | | 1/1966 | Lutz | |
| 4,346,928 | A | | 8/1982 | Towsend | |
| 4,747,174 | A | * | 5/1988 | Hightower | E01H 1/02 15/49.1 |
| 5,140,763 | A | | 8/1992 | Nichols, IV | |
| 5,182,830 | A | * | 2/1993 | Viola | E01H 1/02 15/160 |
| 5,309,654 | A | | 5/1994 | Mathis | |
| 5,477,927 | A | * | 12/1995 | Figura | A01B 45/02 172/29 |
| 5,815,956 | A | * | 10/1998 | Lavin | E01H 5/06 37/234 |
| 6,088,865 | A | * | 7/2000 | Truan | E01H 1/02 15/190 |
| 6,691,364 | B1 | * | 2/2004 | Truan | A46B 7/04 15/202 |
| 6,848,142 | B2 | * | 2/2005 | Truan | B62D 49/04 37/468 |
| 7,065,947 | B1 | * | 6/2006 | Street | E01H 1/02 56/378 |
| 7,069,711 | B1 | * | 7/2006 | Connell | A01B 45/00 56/16.7 |
| 7,464,528 | B1 | * | 12/2008 | Street | A01B 51/026 56/371 |
| 10,368,483 | B1 | * | 8/2019 | Howard | A01D 34/001 |
| 10,941,532 | B2 | * | 3/2021 | Slaby | E02F 3/142 |
| 2003/0146632 | A1 | | 8/2003 | Marion et al. | |
| 2016/0201280 | A1 | | 7/2016 | Katahira et al. | |
| 2017/0245722 | A1 | | 8/2017 | Seeley | |

FOREIGN PATENT DOCUMENTS

| | | | |
|---|---|---|---|
| DE | 29901738 | U1 | 7/1999 |
| EP | 0189371 | A1 | 7/1986 |

OTHER PUBLICATIONS

Stork's Plows, "SnowEx SS-4000 Walk Behind Rotary Broom W/ Plow Honda Engine", Product Description, Bernville, USA, accessed on Jan. 29, 2019. Available at https://www.storksplows.com/snowex-ss-4000-walk-behind-rotary-broom.html (6 pages).

* cited by examiner

BRUSH RETROFIT FOR A SNOW REMOVAL VEHICLE

FIELD

This application relates to the field of brush retrofits for mounting behind a snow plow blade of a snow removal vehicle.

INTRODUCTION

Snow removal vehicles may include a snow plow blade mounted to a front end of the vehicle. The snow removal vehicle may be driven forwards into accumulations of snow so that the snow plow blade pushes the snow, thereby clearing the underlying surface (e.g. a walkway, roadway, parking lot, or residential driveways) of snow.

SUMMARY

In one aspect, a multi-position brush retrofit for mounting behind a snow plow blade of a snow removal vehicle is provided. The retrofit may include a base frame, a stationary brush assembly, a brush elevation actuator, and a retrofit mount. The stationary brush assembly may be movably mounted to the base frame. The stationary brush assembly may include at least a first multi-position brush bar mounted to a brush bar support. Each multi-position brush bar may have two or more angularly spaced apart brushing members. Each multi-position brush bar may be rotatable relative to the brush bar support between two or more rotary positions. Each of the brushing members may have an associated one of the rotary positions in which the brushing member is oriented downwards to make brushing contact with snow-covered surfaces. The multi-position brush bar may be rigidly fastenable to the brush bar support at each of the rotary positions to select one of the brushing members for brushing snow-covered surfaces. The brush elevation actuator when activated may move the stationary brush assembly relative to the base frame between a raised storage position and a lowered in-use position. The retrofit mount may be configured to secure the base frame to a support structure of the snow removal vehicle behind the snow plow blade.

In another aspect, a multi-position brush retrofit for mounting behind a snow plow blade of a snow removal vehicle is provided. The retrofit may include a base frame, a stationary brush assembly movably mounted to the base frame, a brush elevation actuator, and a retrofit mount. The stationary brush assembly may include at least first and second multi-position brush bars mounted to a brush bar support. Each multi-position brush bar may have at least one brushing member. The second multi-position brush bar may be positioned laterally and rearwardly offset from the first multi-position brush bar. The brush elevation actuator when activated may move the stationary brush assembly relative to the base frame between a raised storage position and a lowered in-use position. The retrofit mount may be configured to secure the base frame to a support structure of the snow removal vehicle behind the snow plow blade.

In another aspect, a brush retrofit for mounting behind a snow plow blade of a snow removal vehicle is provided. The brush retrofit may include a base frame, a stationary brush assembly movably mounted to the base frame, a brush elevation actuator, and a retrofit mount. The stationary brush assembly may include at least first and second brush bars mounted to a brush bar support. Each brush bar may have a plurality of individually removable brushing members. Each brushing member may be movable laterally relative to a respective brush bar to disconnect the brushing member from the respective brush bar. The second brush bar may be positioned laterally and rearwardly of the first brush bar. The brush elevation actuator when activated may move the stationary brush assembly relative to the base frame between a raised storage position and a lowered in-use position. The retrofit mount may be configured to secure the base frame to a support structure of the snow removal vehicle behind the snow plow blade.

DRAWINGS

DESCRIPTION OF VARIOUS EMBODIMENTS

Figure 1:
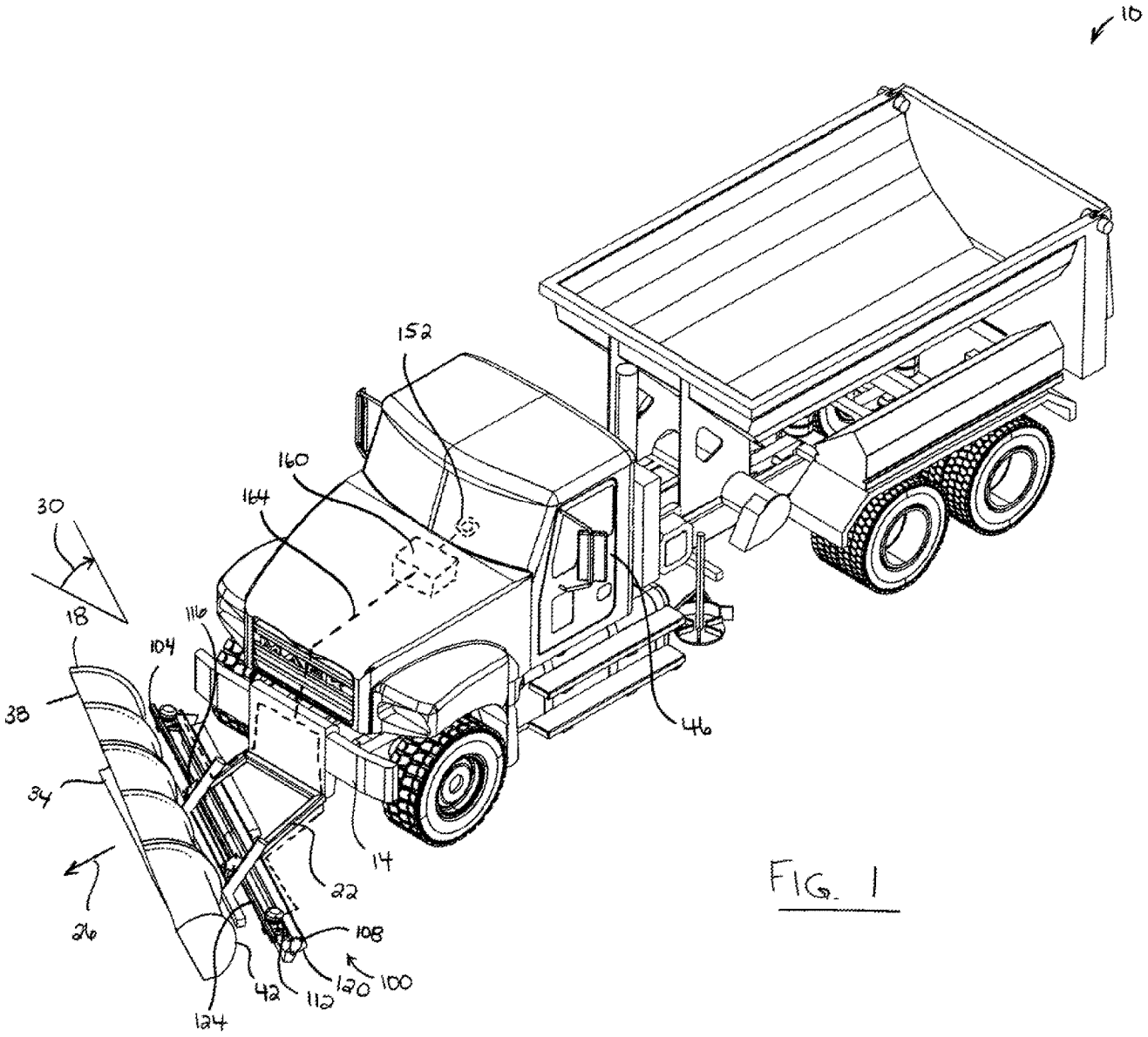
FIG. 1 is a perspective view of a snow removal vehicle including a snow plow blade and multi-position brush retrofit, in accordance with an embodiment.

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", "joined", "affixed", or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly joined", "directly affixed", or "directly fastened" where the parts are connected in physical contact with each other. As used herein, two or more parts are said to be "rigidly coupled", "rigidly connected", "rigidly attached", "rigidly joined", "rigidly affixed", or "rigidly fastened" where the parts are coupled so as to move as one while maintaining a constant orientation relative to each other. None of the terms "coupled", "connected", "attached", "joined", "affixed", and "fastened" distinguish the manner in which two or more parts are joined together.

Further, although method steps may be described (in the disclosure and/or in the claims) in a sequential order, such methods may be configured to work in alternate orders. In other words, any sequence or order of steps that may be described does not necessarily indicate a requirement that the steps be performed in that order. The steps of methods described herein may be performed in any order that is practical. Further, some steps may be performed simultaneously.

As used herein and in the claims, a group of elements are said to 'collectively' perform an act where that act is performed by any one of the elements in the group, or performed cooperatively by two or more (or all) elements in the group.

Some elements herein may be identified by a part number, which is composed of a base number followed by an alphabetical or subscript-numerical suffix (e.g. 112*a*, or $\mathbf{112}_1$). Multiple elements herein may be identified by part numbers that share a base number in common and that differ by their suffixes (e.g. $\mathbf{112}_1$, $\mathbf{112}_2$, and $\mathbf{112}_3$). All elements with a common base number may be referred to collectively or generically using the base number without a suffix (e.g. 112).

Referring to FIG. 1, a snow removal vehicle 10 is shown having a front end 14 to which a snow plow blade 18 is mounted by a support structure 22. In use, snow removal vehicle 10 may be driven in forwards direction 26 to push snow that has accumulated on a surface (e.g. walkway, roadway, parking lot, or residential driveways), thereby clearing the surface of the snow (e.g. so that the roadway is safe for driving). Snow removal vehicle 10 may be a large commercial vehicle as shown, or a smaller vehicle for clearing sidewalks and residential driveways.

Snow plow blade 18 and/or support structure 22 may have a configurable angle of attack 30 (i.e. yaw angle). For example, when angle 30 is zero degrees, snow plow blade 18 may be oriented perpendicular to forwards direction 26. This may be suitable for pushing snow forwards to form a snow pile outside the perimeter of the surface. When angle 30 is non-zero degrees as shown, snow plow blade 18 may push snow left or right out of the perimeter of the surface.

As shown, snow plow blade 18 may follow a concavely curved profile from the blade lower edge 34 to the blade upper edge 38. This can mitigate the snow being pushed from overflowing and then falling behind the snow plow blade 18. In use, the blade lower edge 34 is placed in contact with the surface being cleared of snow so that the blade lower edge 34 scrapes the surface. This will typically wear down the blade lower edge 34 over time, so that periodically it may be necessary to replace or repair snow plow blade 18 or blade lower edge 34. Moreover, surfaces being cleared of snow are often uneven. In particular, winter conditions can cause ice-expansion within the surface substrate (e.g. asphalt) which creates raised section on the surface. When blade lower edge 34 strikes such raised sections, the raised section may be essentially destroyed leaving a pothole in the surface. Potholes are hazards for vehicles and pedestrians, and are very costly for governing bodies to repair. For example, the American Automobile Associate reports that potholes cause approximately $3 billion dollars each year in damage to vehicles within the United States of America. New York alone reportedly repairs between 1.5 million to 2.0 million potholes each year, at a cost of between $30 to $50 million dollars.

There are many thousands of snow removal vehicles 10 equipped with snow plow blades 18 that operate on a snow clearing paradigm that involves scraping the surface being cleared of snow with the blade lower edge 34. Replacing these vehicles or replacing their snow plow blades with different vehicles or blade assemblies that operate in a different manner (e.g. that mitigates one or more of the problems noted above) would be extremely costly for their operators.

In one aspect, embodiments described herein relate to a multi-position brush retrofit 100 for mounting behind a snow plow blade 18 of a snow removal vehicle 10. The multi-position retrofit includes a brush assembly that sweeps the surface being cleared of snow, from behind the snow plow blade. This can allow the snow plow blade to be positioned at a blade height slightly raised (e.g. 0.5 to 3 inches) above the surface being cleared of snow. The brush assembly may be positioned at a height that makes brushing contact with the surface, so that the brush assembly clears the snow remaining on the surface after the snow plow blade. The brush assembly may clear snow on raised sections of the surface without damaging the surface (i.e. without creating potholes). In the result, the raised positioned of the snow plow blade may reduce or eliminate wearing on the blade lower edge, and may reduce or eliminate the snow plow blade striking raised sections of the surface and creating potholes. This may reduce or eliminate the cost of repairing or replacing the snow plow blade or blade lower edge, and may reduce or eliminate the cost of damage caused by potholes and the cost of repairing potholes.

In some embodiments, the brush assembly may include multiple brushing members that can be used in sequence. This can provide the brush assembly with an extended life span before replacement brush members are required. The brush assembly as a whole, and/or the brushing members (individually or as a collective) may be replaced at an economical cost compared with replacing a snow plow blade. This may reduce the cost of operating the snow removal vehicle.

Moreover, the multi-position brush retrofit is configured to be mounted behind the existing snow plow blade of a snow removal vehicle. Therefore, one or more (or all) of the benefits of the multi-position brush retrofit described above may be enjoyed by an existing snow removal vehicle without having to replace the existing snow plow blade (or the entire snow removal vehicle).

In some embodiments, the multi-position brush retrofit may help roughen (e.g. create a pattern of pits and scratches) on hard packed snow and ice, which can result in one or more (or all) of: (i) greater tire traction for the snow removal vehicle and (ii) greater salt penetration. This may help reduce salt and sand consumption, which may together provide cost savings and environmental benefits.

In some embodiments, the multi-position brush retrofit may also be used to sweep sand off roads during spring cleanup, which may create additional utility for snow removal vehicles during off-season.

Figure 2:
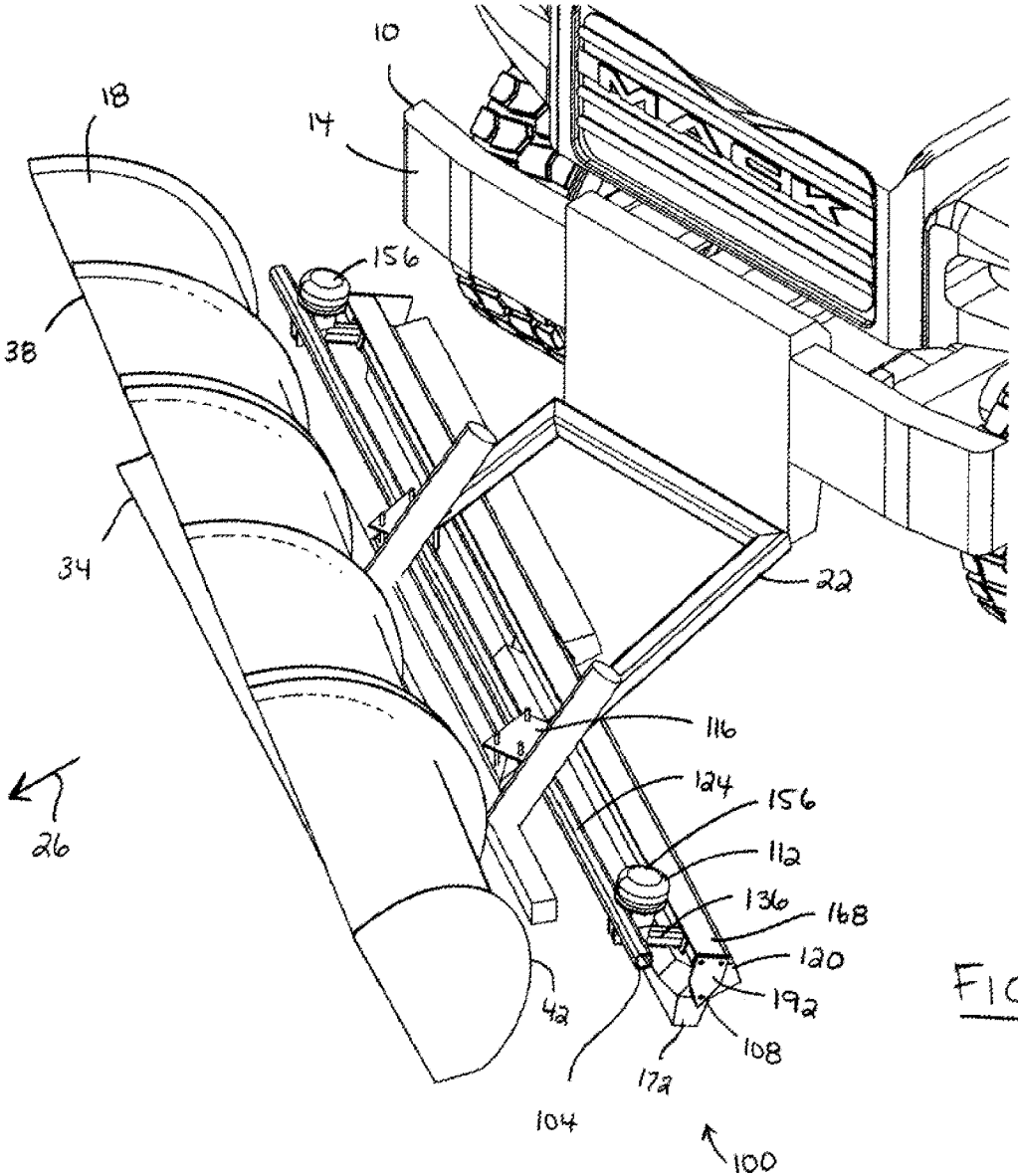
FIG. 2 is an enlarged view of a portion of FIG. 1.
Figure 3:
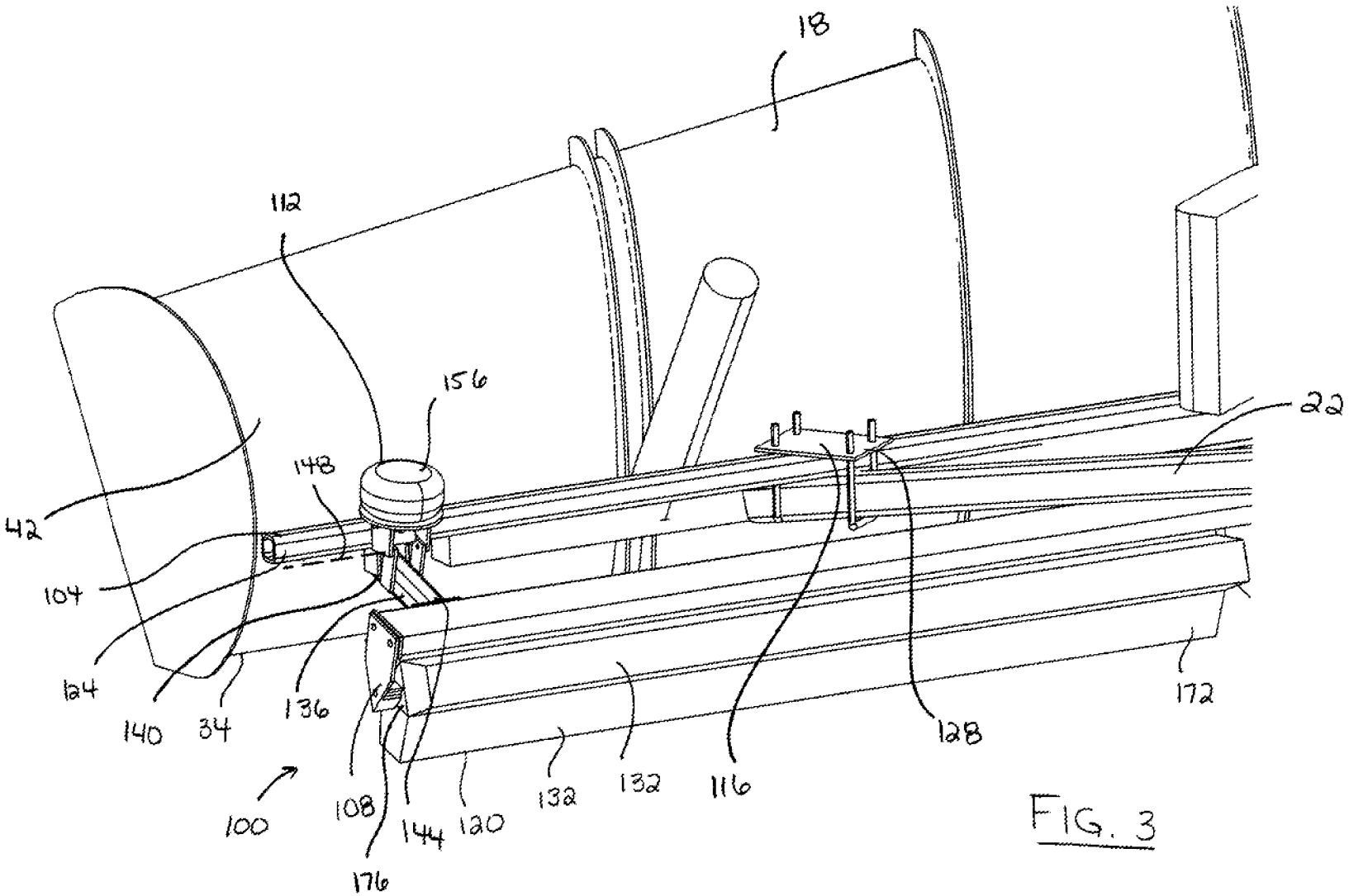
FIG. 3 is a rear perspective view of a portion of FIG. 1, including a portion of the snow plow blade and the multi-position brush retrofit.

Reference is now made to FIGS. 2-3. As shown, multi-position brush retrofit 100 may include a base frame 104, a stationary brush assembly 108, a brush elevation actuator 112, and a retrofit mount 116. Base frame 104 may be secured to snow plow blade support structure 22 by retrofit mount 116. Stationary brush assembly 108 may be movably mounted to base frame 104, and movable between a raised storage position and a lowered in-use position by brush elevation actuator 112. Stationary brush assembly 108 may include one or many brush bars 120. For clarity, the term 'stationary' in the name 'stationary brush assembly' refers to the constituent brush bar(s) 120 being rotationally-stationary (i.e. non-rotating) during snow clearing operations (i.e. while brushing a surface to be cleared of snow). This may contrast with apparatus in which a cylindrical brush assembly is motor-driven to rotate during snow clearing operations (which may be significantly more costly, and possibly impractical to provide as a retrofit).

Figure 4:
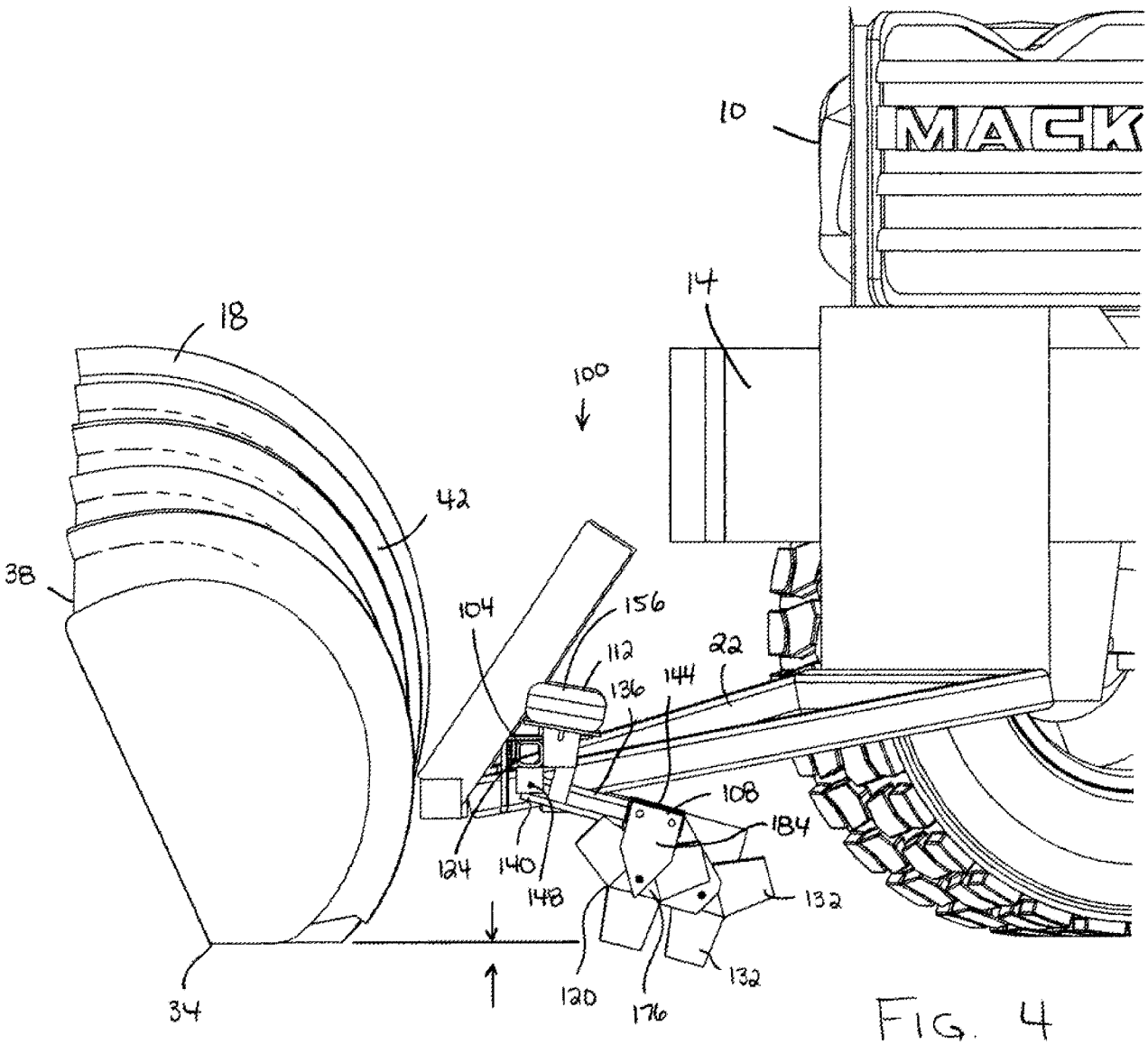
FIG. 4 is a partial side elevation view of the snow removal vehicle of FIG. 1.

Turning to FIGS. 3-4, multi-position brush retrofit 100 may include any base frame 104 suitable for carrying stationary brush assembly 108 and for mounting behind a snow plow blade 18. As shown, multi-position brush retrofit 100 may be located rearwardly of blade rear end 42. In some embodiments, base frame 104 may include a laterally extending beam 124. In the illustrated example, base frame 104 overlies portions of snow plow blade support structure 22. This can allow base frame 104 to rest the weight of stationary brush assembly 108 onto the snow plow blade support structure 22. Alternatively, or in addition, base frame 104 may extend below portions of plow blade support structure 22 (with suitable retrofit mount(s) 116 for securing base frame 104 to the blade support structure 22 above).

Still referring to FIG. 3, retrofit mount 116 may be any device suitable to rigidly connect base frame 104 behind snow plow blade 18. For example retrofit mount 116 may rigidly connect base frame 104 to blade support structure 22 as shown. In the illustrated example, retrofit mount 116 includes one (or many as shown) clamps 128 that clamp base frame 104 against plow blade support structure 22. This can allow retrofit mount 116 to rigidly connect base frame 104 to blade support structure 22 in a removable, non-destructive manner, whereby multi-position brush retrofit 100 can be detached from snow removal vehicle 10 without causing damage. When removed, the multi-position brush retrofit 100 may be reattached to a different snow removal vehicle 10 (e.g. in the case that the previous snow removal vehicle 10 is decommissioned for repairs or replacement).

Alternatively or in addition to clamps 128, retrofit mount 116 may include fastener(s) that penetrate blade support structure 22. This may provide a more permanent connection between base frame 104 and blade support structure 22.

Still referring to FIGS. 3-4, stationary brush assembly 108 may be movably connected to base frame 104 in any manner that allows brush member(s) of stationary brush assembly 108 to change elevation between a raised storage position and a lowered in-use position. For example, stationary brush assembly 108 may be translatably or pivotably movable relative to base frame 104 between the raised and lowered positions. In the raised position, stationary brush assembly 108 may be elevated so that the brush member(s) 132 do not make brushing contact with the surface below. The operator may move stationary brush assembly 108 to the raised storage position when snow removal vehicle 10 is not located at a surface to be cleared of snow (e.g. when traveling to a surface to be cleared of snow, or when returning from the cleared surface). In the lowered in-use position, stationary brush assembly 108 may be positioned at a height at which the brush member(s) 132 make brushing contact with the surface below. The operator may move stationary brush assembly 108 to the lowered in-use position when snow removal vehicle 10 is located at a surface to be cleared of snow.

In the illustrated example, stationary brush assembly 108 is shown rotatably connected to base frame 104 between the raised and lowered positions. As shown, a rotary arm 136 may connect stationary brush assembly 108 to base frame 104. For example, rotary arm 136 may have a first end 140 with a rotary connection to base frame 104, and a second end 144 with a connection to stationary brush assembly 108. There can be any number of such rotary arms 136 (there are two in the example shown). The rotary connection at rotary arm first end 140 may have a laterally extending rotation axis 148.

Referring to FIGS. 1 and 3, stationary brush assembly 108 may be moved between the raised and lowered position by a brush elevation actuator 112. The brush elevation actuator 112 may be any device that can be operated to cause stationary brush assembly 108 to move between the raised and lowered positions. Preferably, brush elevation actuator 112 can be controlled to moved stationary brush assembly 108 between the raised and lowered position by an operator seated in the cab 46 of the snow removal vehicle 10 (e.g. seated in the driver's seat). This can allow the operator to raise and lower stationary brush assembly 108 without exiting the cab 46 and exposing themselves to the elements outside. For example, brush elevation actuator 112 may include a user control 152 (e.g. switch, button, slider, touchscreen, lever, pedal, or other member a user can manipulate to control brush elevation actuator 112) that is operable from within (e.g. positioned inside) vehicle cab 46 to change the position of stationary brush assembly 108.

Brush elevation actuator 112 may include one or more actuators 156 (there are two in the example shown). Actuators 156 can be any device that can be activated to move the stationary brush assembly between the raised and lowered positions. For example, actuators 156 may include one or more fluidic devices (e.g. hydraulic or pneumatic), electric devices (e.g. electric motor or linear solenoid), and/or mechanical devices (e.g. shafts, belt, chains, gears, and/or other mechanical parts) that can be operated by user control 152. In one example, actuators 156 may be fluidic linear actuators connected by fluid lines 164 to a fluid source 160 (e.g. pump or compressor), which is communicatively coupled (e.g. by wire or wirelessly) to user control 152.

FIG. 4 shows an example of stationary brush assembly 108 in a lowered in-use position, in which there are brush members 132 extending (e.g. 0.5 to 3 inches) below blade lower edge 34. In some embodiments, brush elevation actuator 112 is configured to continuously bias brush members 132 downwardly, when in the lowered position, so that brush members 132 can maintain brushing contact with uneven surfaces and can accommodate the gradual wear of brush members 132. In alternative embodiments, brush elevation actuator 112 does not continuously bias brush members 132, but instead maintains brush members 132 at a constant height position.

Figure 5:
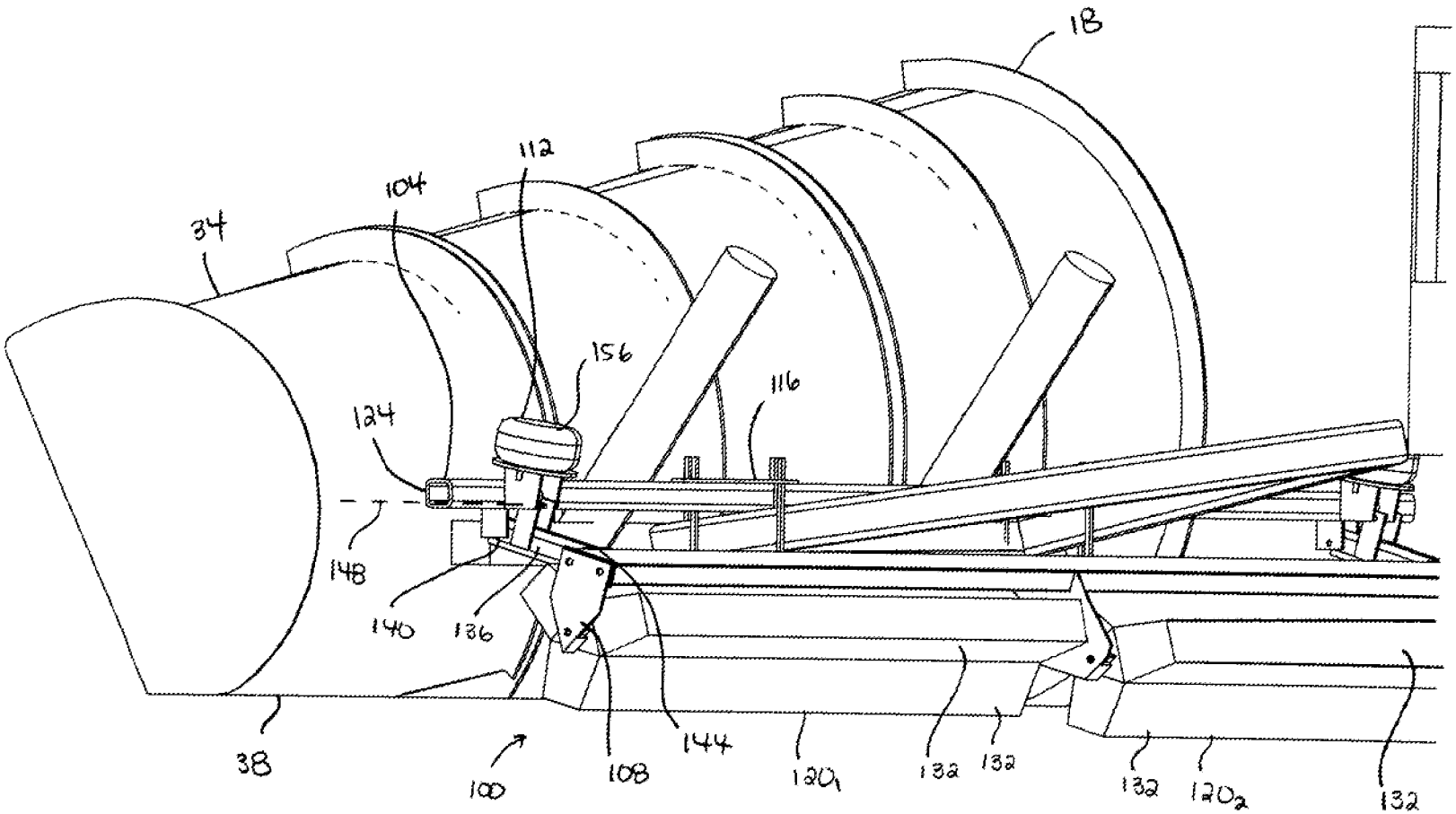
FIG. 5 is a partial rear perspective view of the snow removal vehicle of FIG. 1, showing the snow plow blade and a portion of the multi-position brush retrofit.
Figure 6:
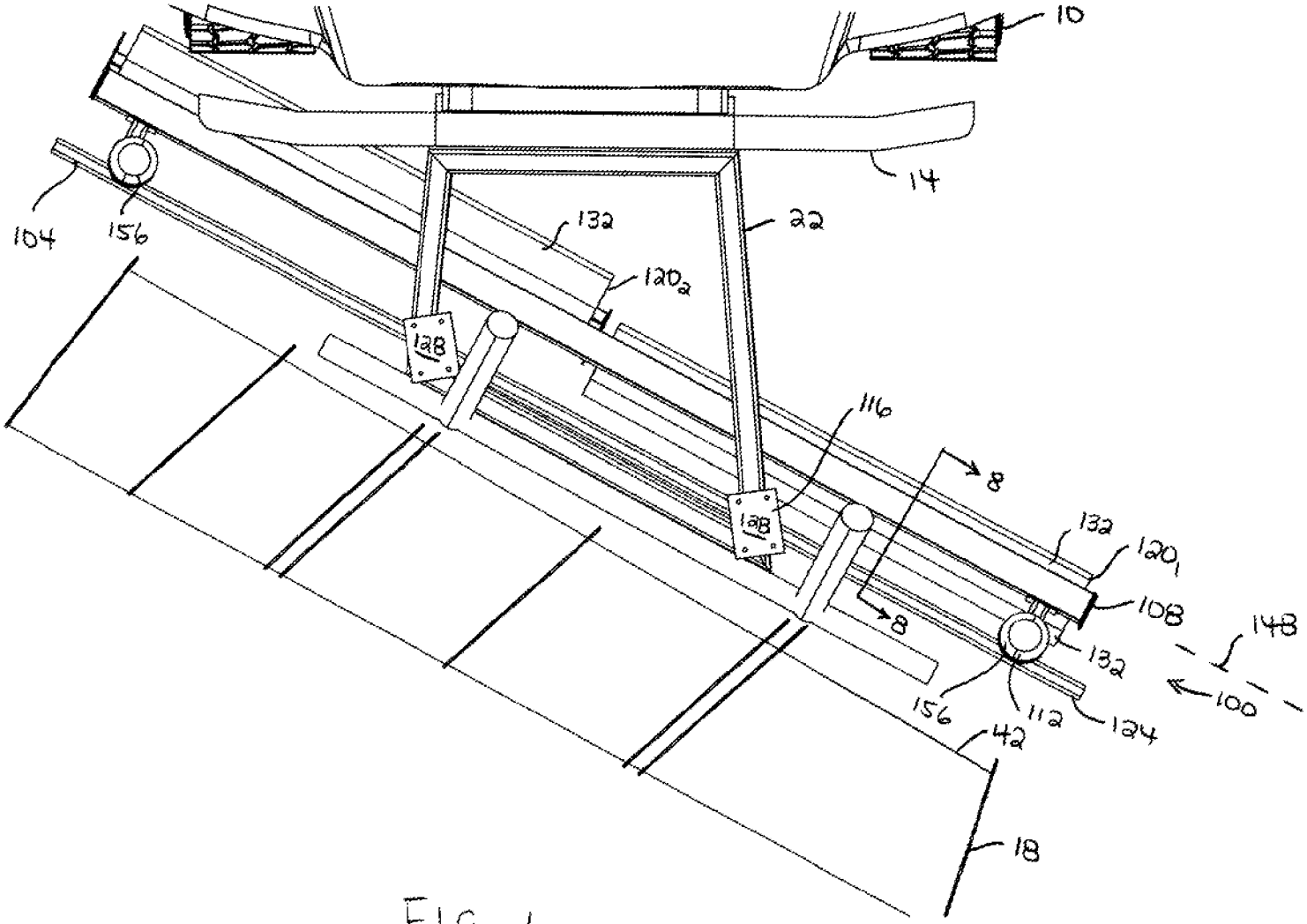
FIG. 6 is a partial top plan view of the snow removal vehicle of FIG. 1, including the snow plow blade and the multi-position brush retrofit.

Turning to FIGS. 5-6, stationary brush assembly 108 may include at least one multi-position brush bar 120 (there are two in the example shown) mounted to a brush bar support 168. Each multi-position brush bar 120 may include two or more (e.g. 2 to 20) angularly spaced apart brushing members 132. In the illustrated example, each brush bar 120 is shown including three brushing members 132 positioned approximately 120 degree apart. As shown, brush bar 120 can be rotated relative to brush bar support 168 between a plurality of rotary positions. Each brush member 132 may be associated with at least one of the rotary positions, in which that brush member 132 is oriented generally downwardly for making brushing contact with the ground surface. The other brush members 132 that are not associated with that rotary position may be elevated from the ground surface. Accordingly, one brush member 132 at a time may be oriented for brushing the ground surface. This can allow the plurality of brush members 132 to be used and worn down individually, in sequence. When a brush member 132 is worn out, the brush bar 120 may be repositioned to a rotary position associated with another brush member 132. Accordingly, the plurality of brush members 132 may be used in sequence, which may provide an extended life span for the brush bar 120.

Alternatively or in addition to including a plurality of discrete brushing members 132, a brush bar 120 may include a continuous (e.g. cylindrical) brush member 132 that is usable to brush ground surfaces in all rotary positions. In some embodiments, brush bar 120 may include one or many brush members, all of which are positioned and oriented to engage a surface below at once. For example, brush bar 120 may not be designed to rotate between multiple rotary positions—instead operating at all times in one particular rotary position.

Figure 13:
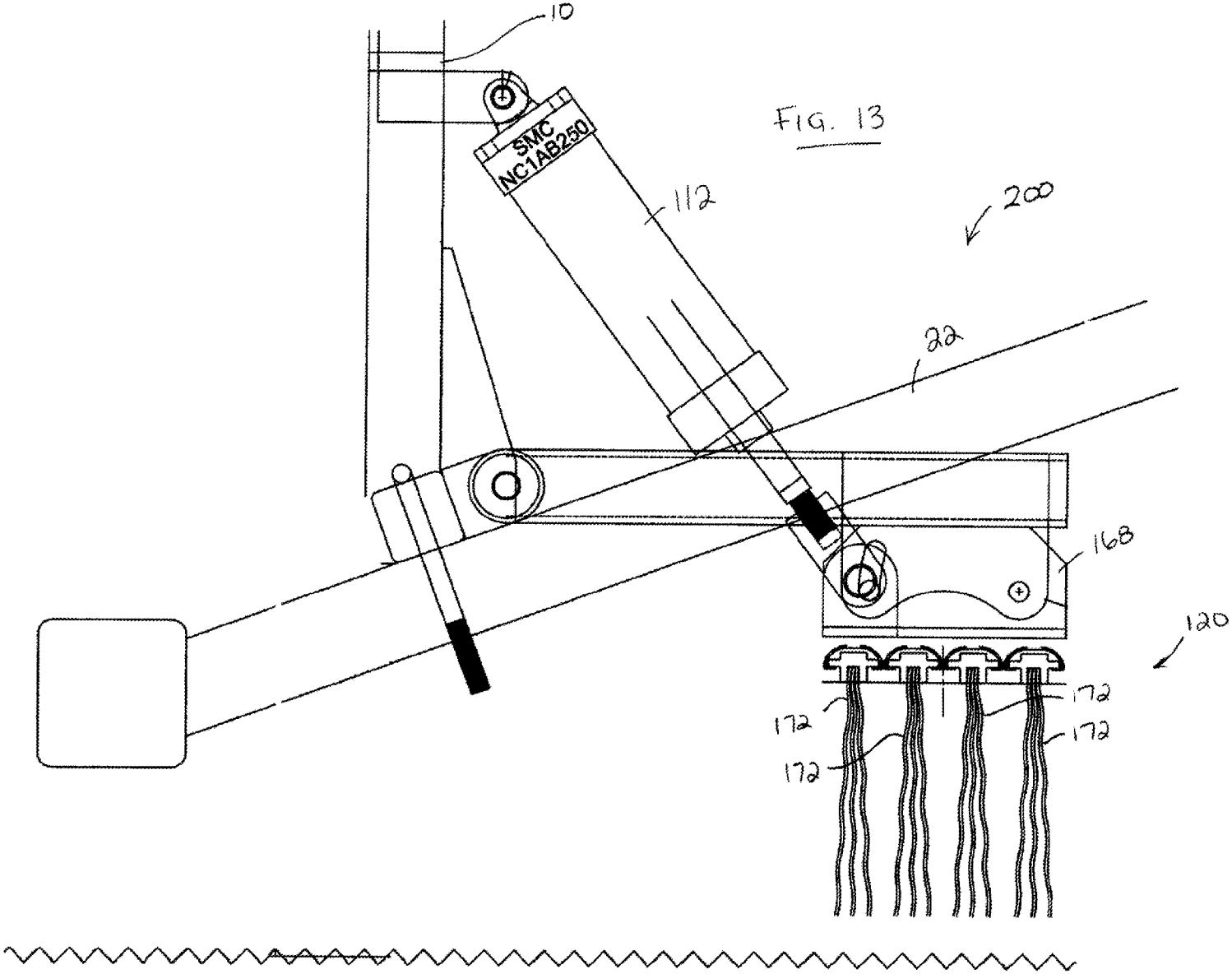
FIG. 13 is a partial side view of a brush retrofit attached to a snow removal vehicle and in a raised position, in accordance with an embodiment.
Figure 14:
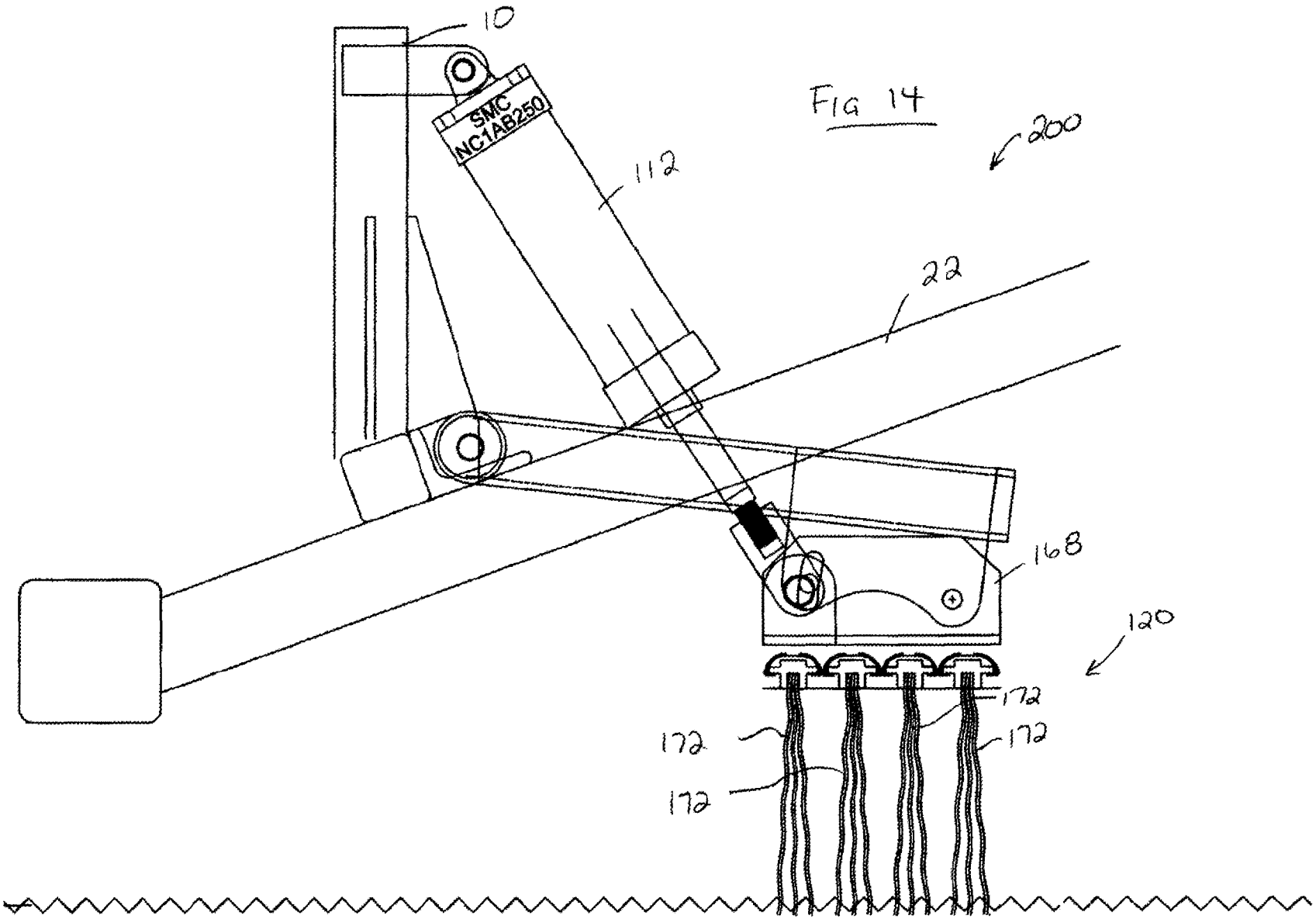
FIG. 14 is a partial side view of the brush retrofit of FIG. 13 in a lowered in-use position.
Figure 15:
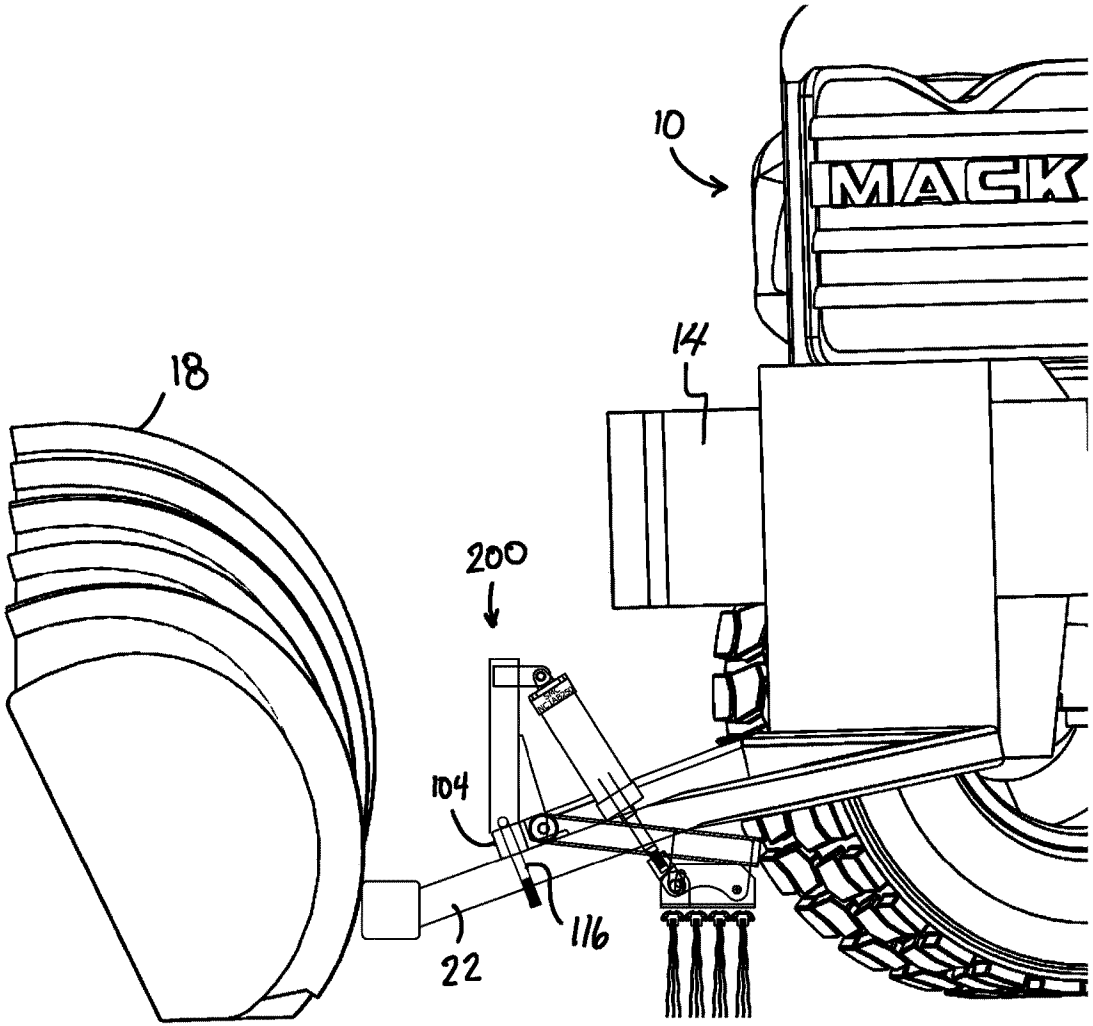
FIG. 15 is a partial side elevation view of the brush retrofit of FIG. 13 attached to a snow removal vehicle.

FIGS. 13-14 show a brush retrofit 200 in accordance with an alternative embodiment. As shown, brush assembly 108 may include a single brush bar 120 composed of several rows of bristles 172. Each row of bristles 172 may be permanently connected to brush bar 120 or removable. In the illustrated embodiment, brush retrofit 200 does not have several rotary positions. FIG. 15 shows retrofit mount 116 securing base frame 104 to snow plow blade support structure 22 of snow removal vehicle 10 at a location between the front end 14 of snow removal vehicle 10 and snow plow blade 18.

Returning to FIGS. 5-6, each brush member 132 can have any configuration suitable for brushing ground surfaces of snow. For example, brush member 132 may include a plurality of bristles 172 (FIG. 5) which collectively span substantially the entire length of its brush bar 120 (e.g. span at least 75% of brush bar 120). The bristles 172 may be formed of high-tensile and long wearing material (e.g. metal, polymer, or nylon).

Referring to FIG. 6, stationary brush assembly 108 may include any number of brush bars 120. For example, stationary brush assembly 108 may include one brush bar 120, or may include a plurality of brush bars 120 that are laterally distributed (e.g. laterally side-by-side), and that collectively span substantially the entire lateral width of snow plow blade 18 (e.g. span at least 75% of the lateral width of snow plow blade 18). As compared with a single brush bar 120, a design with a plurality of brush bars 120 allows more flexibility to repair, replace, or configure individual one's of the brush bars 120. For example, if one of a plurality of brush bars 120 requires repair or replacement, then that repair or replacement can be performed and the other brush bars 120 can continue to be used in their current condition. Still, in other embodiments, stationary brush assembly 108 includes only one brush bar 120.

In some embodiments, stationary brush assembly 108 may include a plurality of brush bars 120 that are rearwardly staggered, as shown. That is, each brush bar 120 may be positioned offset (rearwardly or forwardly) from the brush bar(s) 120 to either side. In the illustrated example, stationary brush assembly 108 includes a first brush bar 1201 and a second brush bar 1202 that is rearwardly offset from first brush bar 1201. This can provide more convenient access to second brush bar 1202 for maintenance, repair, or replacement—as compared to a design in which brush bars 1201 and 1202 are laterally aligned. Still, in other embodiments, brush bars 120 are laterally aligned.

Figure 7:
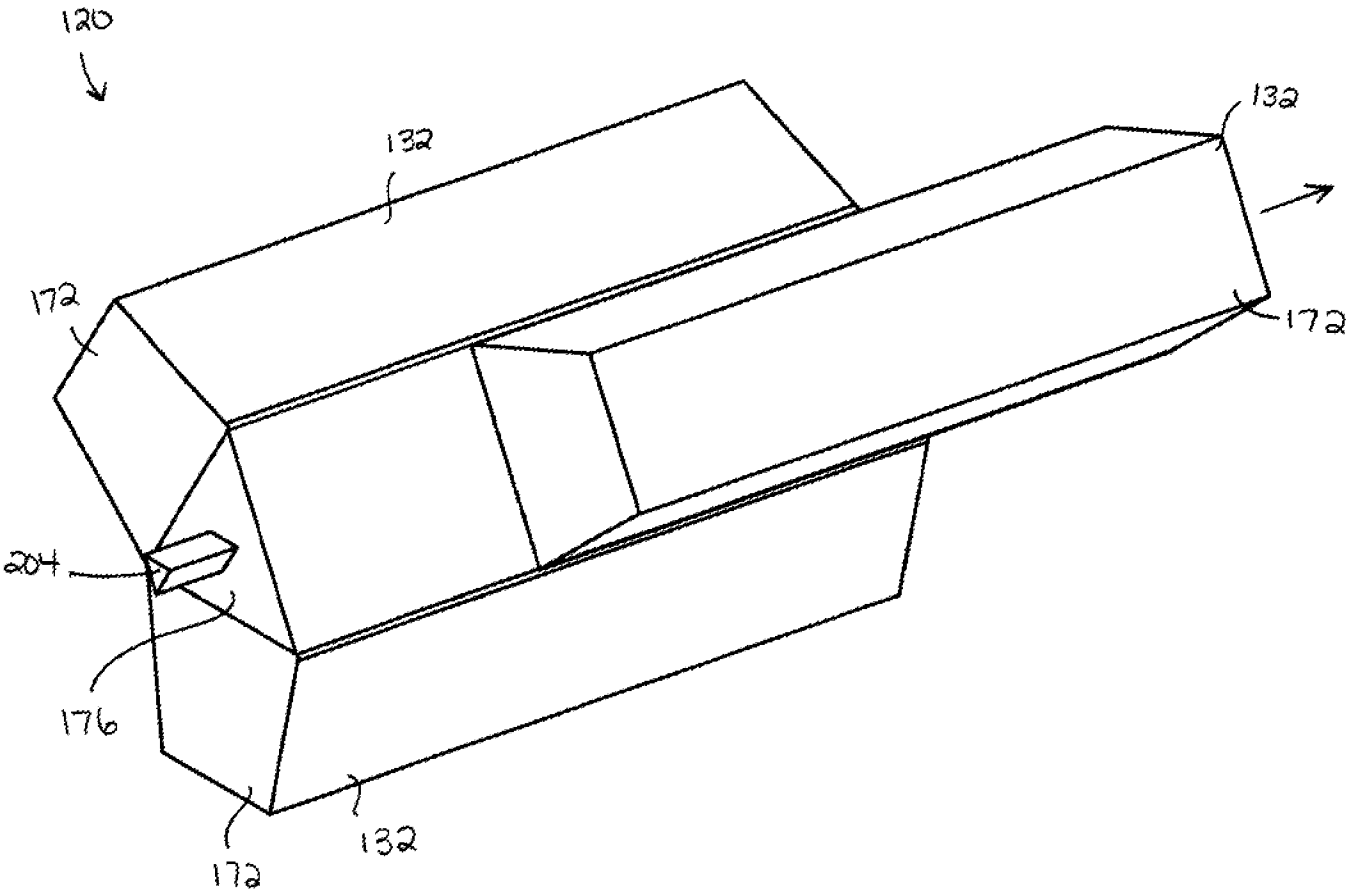
FIG. 7 is a perspective view of a brush bar with a brush member being removed, in accordance with an embodiment.

Referring to FIG. 7, in some embodiments brush members 132 of a brush bar 120 may be removable. For example, brush bar 120 may include a core 176 to which brush members 132 are removably connected. As a brush member 132 wears down with use, the individual brush member 132 may be removed and replaced as illustrated. This design allows each brush member 132 to be individually replaced when required, as compared with a design in which brush bar 120 does not have removable brush members 132. Still, in other embodiments, brush members 132 may be permanently connected to brush bar 120 (e.g. to brush bar core 176). This may simplify the design of brush bar 120 to the extent that removable connections between brush members 132 and core 176 are not required.

Figure 8:
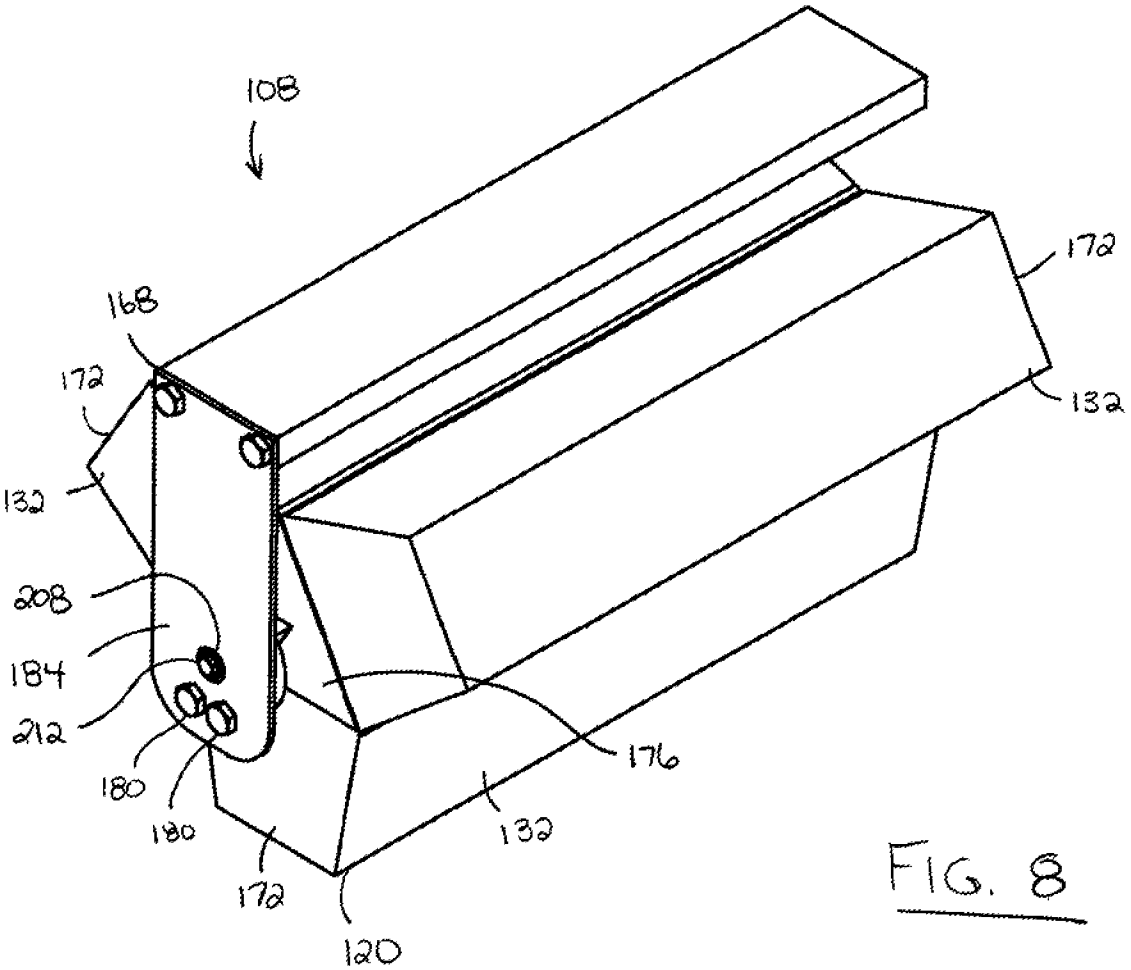
FIG. 8 is a perspective view of a stationary brush assembly, sectioned along line 8-8 in FIG. 6, in accordance with an embodiment.

Reference is now made to FIG. 8. A brush bar 120 may be connected to a brush bar support 168 in any manner that allows the brush bar 120 to be moved between the plurality of rotary positions (at least one rotary position associated with each brush member 132), and that allows the brush bar 120 to be rigidly connected to the brush bar support 168 in each of those rotary positions. When rigidly connected in this manner, the brush bar 120 is inhibited from rotating relative to brush bar support 168, so that the downwardly oriented brush member 132 can make brushing contact with the ground surface without rotating out of position.

Figures 9, 10:
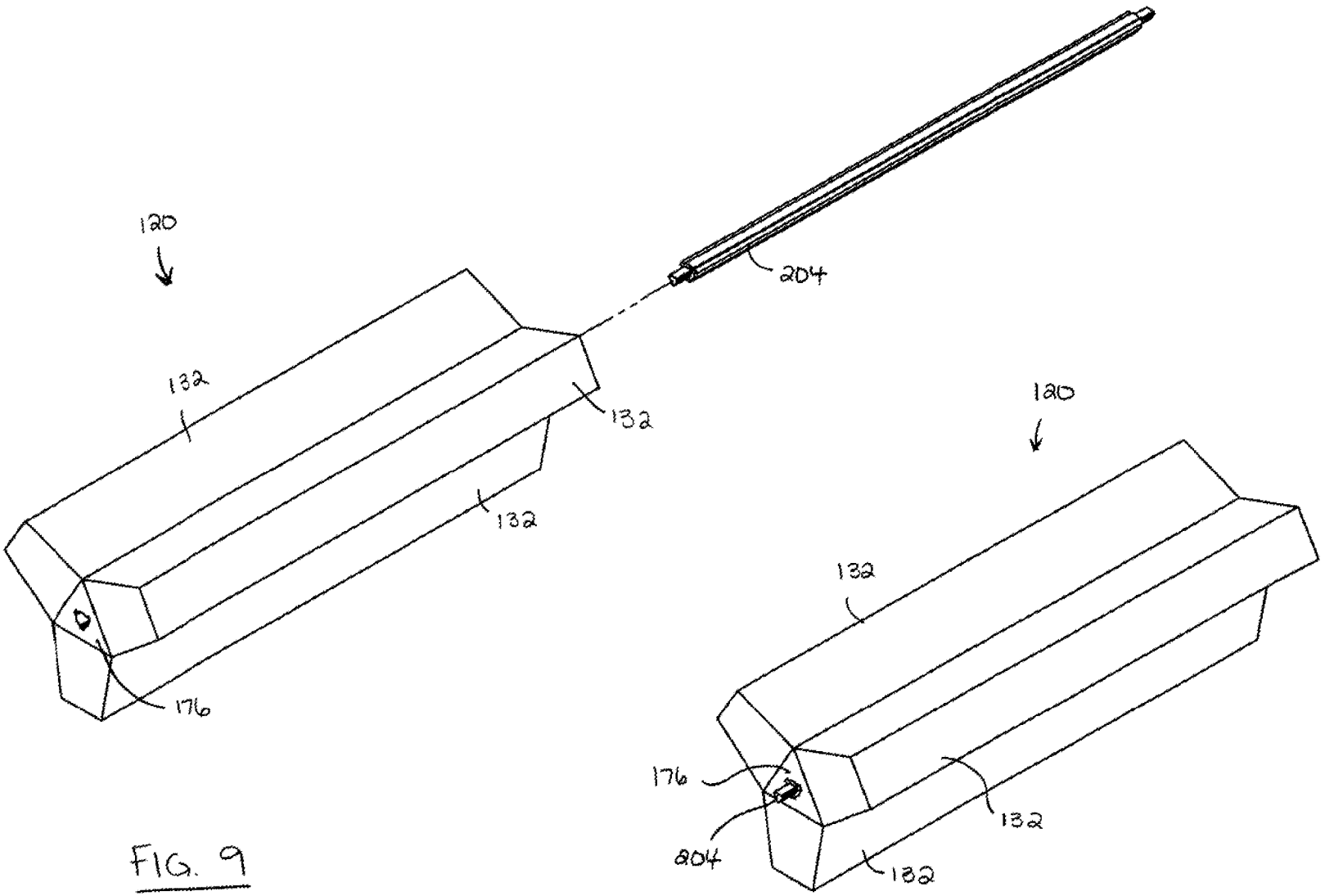
FIG. 9 is an exploded view of a brush bar, in accordance with an embodiment.
FIG. 10 is a perspective view of a brush bar, in accordance with an embodiment.
Figure 11:
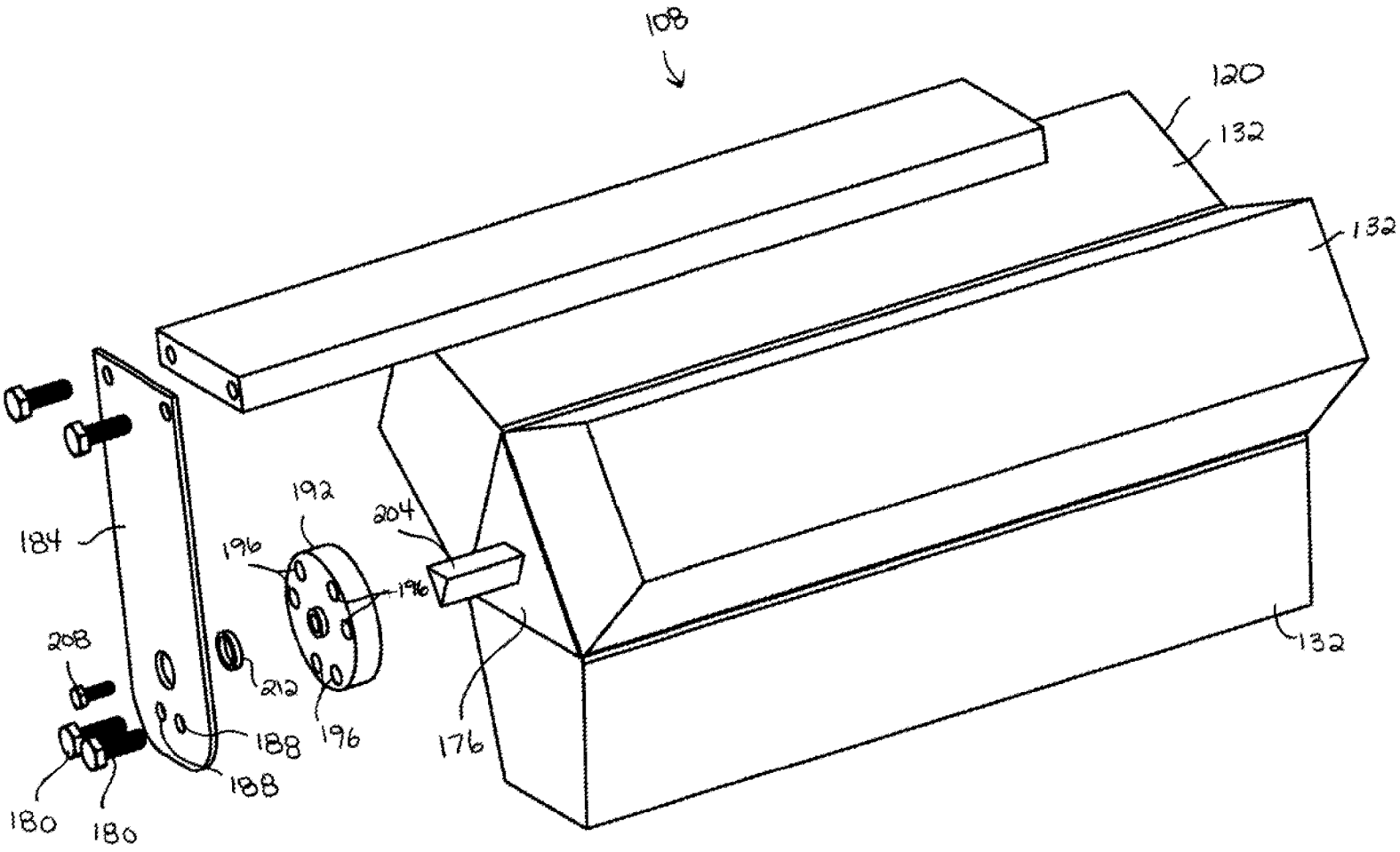
FIG. 11 is an exploded front perspective view of a stationary brush assembly, sectioned along line 8-8 in FIG. 6, in accordance with an embodiment.
Figure 12:
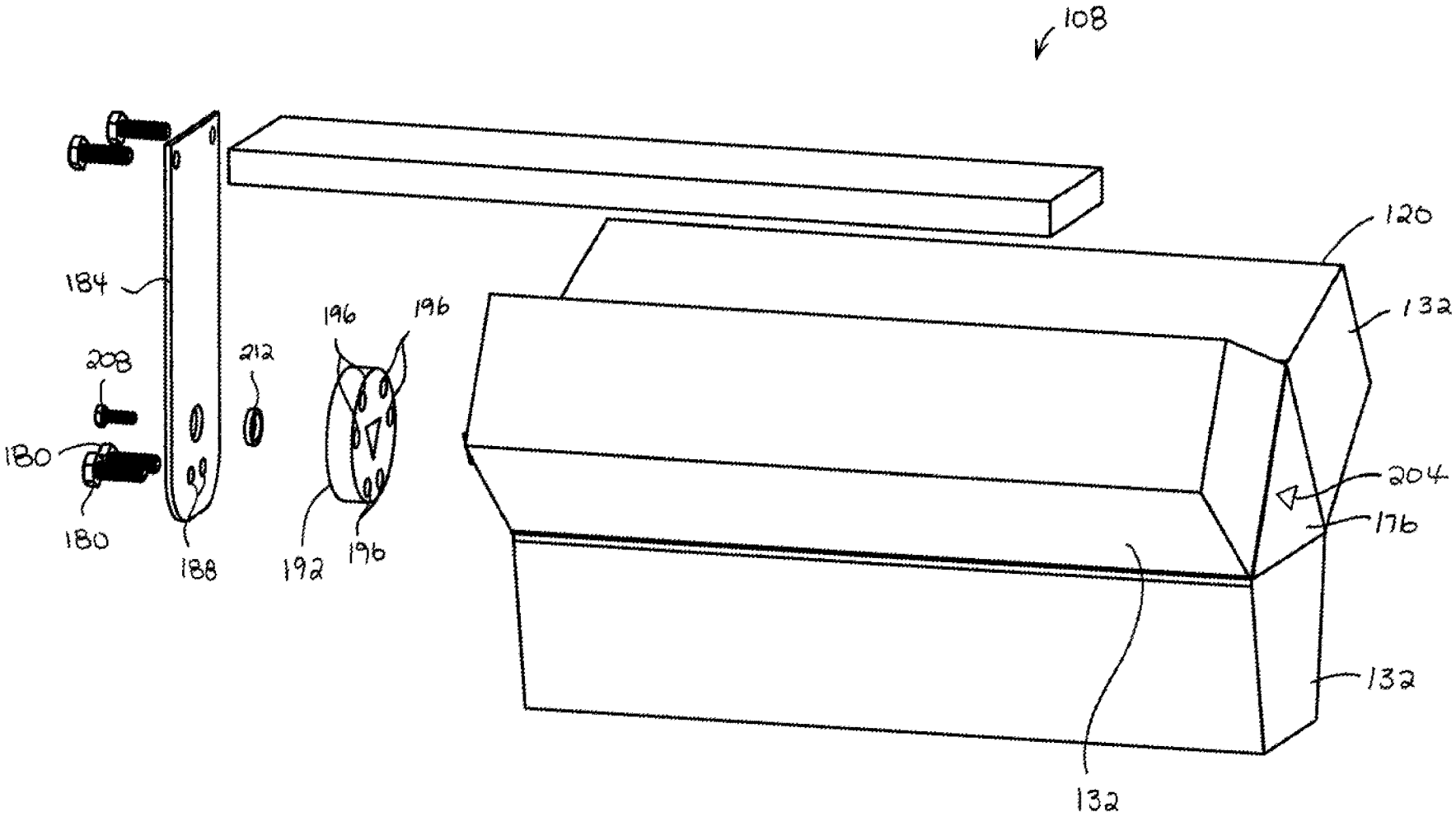
FIG. 12 is an exploded rear perspective view of a stationary brush assembly, sectioned along line 8-8 in FIG. 6, in accordance with an embodiment.

Turning to FIGS. 9-11, stationary brush assembly 108 may include one or more retainers 180. Retainers 180 can have any configuration that when engaged, collectively act to inhibit brush bar 120 from rotating relative to brush bar support 168. For example, retainers 180 may engage brush bar 120 and brush bar support 168 in the engaged position to inhibit brush bar 120 from rotating relative to brush bar support 168. As examples, retainers 180 may include one or more (or all) of locks, latches, pins, and fasteners. In some embodiments, retainers 180 may include threaded fasteners (e.g. screws or bolts) as shown.

Retainers 180 may extend through aligned openings in brush bar 120 and brush bar support 168 to thereby engage both of brush bar 120 and brush bar support 168 and inhibit relative rotation therebetween. As shown, brush bar support 168 may include an end member 184 (e.g. an end wall) having one or more retainer openings 188, and brush bar 120 may include an end member 192 (e.g. an end wall) having one or more retainer openings 196. One or more of support opening(s) 188 may align with one or more of bar opening(s)

196 in at least one rotary position corresponding to each brush member 132. For example, openings 188 may align with at least some openings 196 in at least three rotary positions, where in each rotary position a different one of brush members 132 is oriented downwardly to brush the ground surface below.

In the illustrated example, support end wall 184 includes two retainer openings 188, and bar end wall 192 includes six retainer openings 196. Each pair of bar openings 196 corresponds to a different one of brush members 132, and each pair of bar openings 196 can align with the two retainer openings 188 in one of the available rotary positions. In use, when the two retainer openings 188 are aligned with one of the pairs of bar openings 196, a pair of retainers (e.g. threaded fasteners) 180 may be inserted through the aligned openings 188, 196 to inhibit relative rotation between brush bar support 168 and brush bar 120.

It will be appreciated that support end wall 184 and bar end wall 192 can each include any number of openings 188, 196, and that the same or different openings 188, 196 may align in two or more or all rotary positions corresponding to the brush members 132. For example, bar end wall 192 may include only two retainer openings 192, which align with different pairs of the six support retainer openings 188 in the different rotary positions.

Still referring to FIGS. 9-12, in some embodiments, brush bar 120 may be rotatably connected to brush bar support 168 when retainer(s) 180 are disengaged. For example, upon disengaging retainer(s) 180, brush bar 120 may be rotated relative to brush bar support 168 between the different rotary positions while brush bar 120 remains connected to brush bar support 168. This can allow brush bar 120 to be rotated to change the brush member 132 that is oriented downwards without having to remove brush bar 120 from brush bar support 168. This may make changing the rotary position of brush bar 120 quick and easily done by a single user.

Brush bar 120 may be rotatably connected to brush bar support 168 in any manner that allows brush bar 120 to rotate between different rotary positions when retainer(s) 180 are disengaged. As shown, brush bar 120 may include an axle 204 that extends longitudinally through a center of brush bar core 176. Brush axle 204 may be connected to an end member 192 (e.g. by a fastener 208, or by other means). End member 192 may be rotatably connected to brush bar support end member 184. For example, end member 192 may be rotatably connected to brush bar support end member 184 by rotary bearing 212 (e.g. bushing or rolling-element bearing). The same or similar arrangement may be provided at the other end of the brush bar 120 (not shown).

In use, retainers 180 may be disengaged (e.g. bolts 180 may be removed) while brush bar 120 remains rotatably connected to brush bar support 168 by rotary bearing 212. Brush bar 120 may then be rotated to another rotary position, and retainers 180 re-engaged whereby brush bar 120 is inhibited from rotating relative to brush bar support 168.

Still, in other embodiments, it may be required to disconnect brush bar 120 from brush bar support 168 in order to change the rotary position of brush bar 120. Although, this may be less convenient, this design may have a lower production cost to the extent that a rotary connection between brush bar 120 and brush bar support 168 may not be required.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

Items

Item 1: A multi-position brush retrofit for mounting behind a snow plow blade of a snow removal vehicle, the retrofit comprising:

a base frame;

a stationary brush assembly movably mounted to the base frame, the stationary brush assembly comprising at least a first multi-position brush bar mounted to a brush bar support, each multi-position brush bar having two or more angularly spaced apart brushing members, each multi-position brush bar being rotatable relative to the brush bar support between two or more rotary positions, each of the brushing members having an associated one of the rotary positions in which the brushing member is oriented downwards to make brushing contact with snow-covered surfaces, wherein the multi-position brush bar is rigidly fastenable to the brush bar support at each of the rotary positions to select one of the brushing members for brushing snow-covered surfaces;

a brush elevation actuator that when activated moves the stationary brush assembly relative to the base frame between a raised storage position and a lowered in-use position; and a retrofit mount configured to secure the base frame to a support structure of the snow removal vehicle behind the snow plow blade.

Item 2: The multi-position brush retrofit of any preceding item, wherein:

the stationary brush assembly comprises one or more retainers that are collectively engagable with the first multi-position brush bar and the brush bar support when the first multi-position brush bar is in each of the rotary positions to inhibit the first multi-position brush bar from rotating relative to the brush bar support.

Item 3: The multi-position brush retrofit of any preceding item, wherein:

the one or more retainers comprise one or more threaded fasteners.

Item 4: The multi-position brush retrofit of any preceding item, wherein:

the brush bar support comprises an end wall having a support fastener opening, the first multi-position brush bar comprises an end wall having a plurality of bar fastener openings, the support fastener opening aligns with a different one of the bar fastener openings when the multi-position brush bar is in each of the rotary positions, and one of the threaded fasteners insertable through the support fastener opening and an aligned one of the bar fastener openings to retain the alignment and thereby inhibit the first multi-position brush bar from rotating relative to the brush bar support.

Item 5: The multi-position brush retrofit of any preceding item, wherein:

the first multi-position brush bar is rotatably connected to the brush bar support whereby when the one or more retainers are disengaged, the first multi-position brush bar is rotatable between the two or more rotary positions while remaining connected to the brush bar support.

Item 6: The multi-position brush retrofit of any preceding item, wherein:

for each multi-position brush bar, each of the brushing members is removably connected to the multi-position brush bar and is removable from the multi-position brush bar separately from each of the other brushing members.

Item 7: The multi-position brush retrofit of any preceding item, wherein:

each brushing member comprises a plurality of bristles.

Item 8: The multi-position brush retrofit of any preceding item, wherein:

the at least a first multi-position brush bar comprises a second multi-position brush bar, and the second multi-position brush bar is positioned rearwardly offset from the first multi-position brush bar.

Item 9: The multi-position brush retrofit of any preceding item, wherein:

the brush elevation actuator comprises a fluid powered actuator.

Item 10: The multi-position brush retrofit of any preceding item, wherein:

when in the lowered in-use position, the brush elevation actuator continuously biases the stationary brush assembly downwardly to maintain brushing contact between the selected one of the brushing members and snow-covered surfaces.

Item 11: The multi-position brush retrofit of any preceding item, wherein:

each multi-position brush has three angularly spaced apart brushing members.

Item 12: The multi-position brush retrofit of any preceding item, wherein:

the multi-position retrofit is free of powered devices for rotating the stationary brush assembly.

Item 13: A multi-position brush retrofit for mounting behind a snow plow blade of a snow removal vehicle, the retrofit comprising:

a base frame;

a stationary brush assembly movably mounted to the base frame, the stationary brush assembly comprising at least first and second multi-position brush bars mounted to a brush bar support, each multi-position brush bar having at least one brushing member, the second multi-position brush bar is positioned laterally and rearwardly offset from the first multi-position brush bar;

a brush elevation actuator that when activated moves the stationary brush assembly relative to the base frame between a raised storage position and a lowered in-use position; and a retrofit mount configured to secure the base frame to a support structure of the snow removal vehicle behind the snow plow blade.

Item 14: The multi-position brush retrofit of any preceding item, wherein:

for each multi-position brush bar, each brushing member is removably connected to the multi-position brush bar.

Item 15: The multi-position brush retrofit of any preceding item, wherein:

each brushing member of each multi-position brush bar comprises a plurality of bristles.

Item 16: The multi-position brush retrofit of any preceding item, wherein:

the stationary brush assembly comprises a third multi-position brush bar, and the third multi-position brush bar is positioned rearwardly offset from the second multi-position brush bar.

Item 17: The multi-position brush retrofit of any preceding item, wherein:

the second multi-position brush bar is laterally positioned between the first and second multi-position brush bars.

Item 18: The multi-position brush retrofit of any preceding item, wherein:

the brush elevation actuator comprises a fluid powered actuator.

Item 19: The multi-position brush retrofit of any preceding item, wherein:

when in the lowered in-use position, the brush elevation actuator continuously biases the stationary brush assembly downwardly to maintain brushing contact between a brushing member of each multi-position brush and snow-covered surfaces.

Item 20: The multi-position brush retrofit of any preceding item, wherein:

each multi-position brush has three angularly spaced apart brushing members.

Item 21: The multi-position brush retrofit of any preceding item, wherein:

the multi-position retrofit is free of powered devices for rotating the stationary brush assembly.

Item 22: A brush retrofit for mounting behind a snow plow blade of a snow removal vehicle, the retrofit comprising:

a base frame;

a stationary brush assembly movably mounted to the base frame, the stationary brush assembly comprising at least first and second brush bars mounted to a brush bar support, each brush bar having a plurality of individually removable brushing members, each brushing member being movable laterally relative to a respective brush bar to disconnect the brushing member from the respective brush bar;

the second brush bar being positioned laterally and rearwardly of the first brush bar;

a brush elevation actuator that when activated moves the stationary brush assembly relative to the base frame between a raised storage position and a lowered in-use position; and a retrofit mount configured to secure the base frame to a support structure of the snow removal vehicle behind the snow plow blade.

Item 23: The brush retrofit of item 22, further comprising the features of any preceding item.

Item 24: A brush retrofit for mounting behind a snow plow blade of a snow removal vehicle, the brush retrofit comprising:

a base frame;

a brush assembly movably mounted to the base frame, the brush assembly comprising a brush bar mounted to a brush bar support, the brush bar having a plurality of rows of bristles;

a brush elevation actuator that when activated moves the stationary brush assembly relative to the base frame between a raised storage position and a lowered in-use position; and a retrofit mount configured to secure the base frame to a support structure of the snow removal vehicle behind the snow plow blade.

The invention claimed is:

1. A brush retrofit for mounting behind a snow plow blade of a snow removal vehicle, the brush retrofit comprising:

a base frame;

a brush assembly movably mounted to the base frame, the brush assembly comprising a brush bar mounted to a brush bar support, the brush bar having a plurality of rows of bristles;

a brush elevation actuator that when activated moves the brush assembly relative to the base frame between a raised storage position and a lowered in-use position; and a retrofit mount configured to secure the base frame to a snow plow blade support structure of the snow removal vehicle that is carrying the snow plow blade at a location between a front end of the snow removal vehicle and the snow plow blade.

2. The brush retrofit of claim 1, wherein:

at least one row of the plurality of rows of bristles is removably connected to the brush bar.

3. The brush retrofit of claim 1, wherein:

each row of the plurality of rows of bristles is individually removable from the brush bar.

4. The brush retrofit of claim 1, wherein:

the brush elevation actuator comprises a fluid powered actuator.

5. The brush retrofit of claim 1, wherein:

the brush elevation actuator comprises a hydraulic actuator.

6. The brush retrofit of claim 1, wherein:

the brush elevation actuator comprises a pneumatic actuator.

7. The brush retrofit of claim 1, wherein:

the brush elevation actuator comprises an electric powered actuator.

8. The brush retrofit of claim 1, wherein:

the brush elevation actuator comprises a fluidic linear actuator.

9. The brush retrofit of claim 1, wherein:

the brush elevation actuator is communicatively coupled to a user control, and the user control is user operable to activate the brush elevation actuator.

10. The brush retrofit of claim 1, wherein:

the brush elevation actuator is wirelessly coupled to a user control, and the user control is user operable to activate the brush elevation actuator.

11. The brush retrofit of claim 1, wherein:

when in the lowered in-use position, the brush elevation actuator continuously biases the brush assembly downwardly to maintain brushing contact between the brush bar and snow-covered surfaces.

* * * * *